US005172914A

United States Patent [19]

Primerano

[11] Patent Number: 5,172,914

[45] Date of Patent: Dec. 22, 1992

[54] APPARATUS FOR PROVIDING AN ADJUSTABLY CONTOURED PUTTING SURFACE

[76] Inventor: James Primerano, 327 Wegner Ave., Trenton, N.J. 08619

[21] Appl. No.: 807,330

[22] Filed: Dec. 16, 1991

[51] Int. Cl.[5] ..... A63B 67/02

[52] U.S. Cl. ..... 273/176 H

[58] Field of Search ..... 273/176, 34 R, 34 A, 273/178 B, 179 R, 179 C, 179 E, 182 R, 182 A, 183 R, 195 R, 195 B, 32 R, 180, 722 R, 125 R

[56] References Cited

U.S. PATENT DOCUMENTS

| | | | |
|---|---|---|---|
| 2,334,540 | 11/1943 | Buffham | 273/176 |
| 2,678,823 | 5/1954 | Hugman | 273/176 |
| 3,170,694 | 2/1965 | Dolce | 273/176 |
| 3,522,947 | 8/1970 | Anderson et al. | 273/176 |
| 3,534,961 | 10/1970 | Tiley | 273/176 |
| 3,595,581 | 7/1971 | Anderson et al. | 273/176 |
| 3,601,407 | 8/1971 | Lorrance | 273/176 |
| 3,658,343 | 4/1972 | Rogers | 273/176 H |
| 3,690,673 | 9/1972 | Occhipinti | 273/176 |
| 3,727,917 | 4/1973 | MacLean | 273/176 |
| 3,831,949 | 8/1974 | Henning | 273/176 |
| 3,871,661 | 3/1975 | Korff | 273/176 |
| 3,892,412 | 7/1975 | Koo | 273/176 |
| 3,909,006 | 9/1975 | Arbaugh | 273/176 |
| 3,990,708 | 11/1976 | Ingwersen | 273/176 |
| 4,222,568 | 9/1980 | Russo | 213/176 |
| 4,240,637 | 12/1980 | Cross et al. | 273/176 |
| 4,247,112 | 1/1981 | Del Raso | 273/176 |
| 4,743,027 | 5/1988 | Simjian | 273/176 |
| 4,783,075 | 11/1988 | Simjian | 273/176 |
| 4,790,538 | 12/1988 | Gettelfinger | 273/176 |
| 5,002,280 | 3/1991 | Hines | 273/176 |
| 5,005,837 | 4/1991 | Martinez | 273/176 |

*Primary Examiner*—Mark Graham

*Attorney, Agent, or Firm*—Sperry, Zoda & Kane

[57] ABSTRACT

An apparatus for providing an adjustably contoured putting surface which includes a main platform defining an upper surface thereof which is somewhat flexibly resilient to vary the contour of the upper surface. The apparatus includes at least one intermediate suspended support member held upwardly in spaced relation with respect to the floor by two longitudinally extending suspension members such as rods or the like. A pivotable platform support member is positioned at least on one end of the main platform for pivotal movement thereof. The suspension of the intermediate suspended support member allows rotation of the supported section due to suspension thereof by the two longitudinally extending suspension members above the surrounding floor area.

17 Claims, 2 Drawing Sheets

APPARATUS FOR PROVIDING AN ADJUSTABLY CONTOURED PUTTING SURFACE

BACKGROUND OF THE INVENTION

1. Field of the Invention

The present invention deals with the field of devices usable for the practice of sports and in particular golf. With the present invention the contour of the putting surface or upper surface of a practice area can be varied as desired by a user.

There is a need in the current day lifestyle for a quick and convenient means for relaxation or practicing of the putting golf stroke in an indoor environment. The previous work in this field has resulted in very complicated and expensive configurations which do not have all the aspects of convenience and freedom of maintenance of the design disclosed herein.

2. Description of the Prior Art

There have been many prior art devices patented for facilitating the practice of golf putting such as U.S. Pat. No. 2,334,540 issued Nov. 16, 1943 to W. S. Buffham on a Golf Putting Practice Green; U.S. Pat. No. 2,678,823 issued May 18, 1954 to R. Hugman on a Gutter Area For Indoor Putting Games; U.S. Pat. No. 3,170,694 issued Feb. 23, 1965 to J. Dolce on a Variable-Surface Game Table; U.S. Pat. No. 3,522,947 issued Aug. 4, 1970 to R. Anderson et al on a Golf Green; U.S. Pat. No. 3,534,961 issued Oct. 20, 1970 to W. Tiley on a Game Apparatus Including Selectively Contourable Playing Surface; U.S. Pat. No. 3,595,581 issued Jul. 27, 1971 to R. Anderson et al on a Golf Green; U.S. Pat. No. 3,601,407 issued Aug. 24, 1971 to A. Lorrance on a Variable Playing Surface Game Device; U.S. Pat. No. 3,690,673 issued Sep. 12, 1972 to P. Occhipinti on a Selectively Contourable Putting Green; U.S. Pat. No. 3,727,917 issued Apr. 17, 1973 to G. MacLean on a Variable Contour Golf Putting Device; U.S. Pat. No. 3,831,949 issued Aug. 27, 1974 to G. Henning on a Variable Contour Miniature Golf Device; U.S. Pat. No. 3,871,661 issued Mar. 18, 1975 to W. Korff on a Putting Green; U.S. Pat. No. 3,892,412 issued Jul. 1, 1975 to B. Koo on a Putting Practice Green; U.S. Pat. No. 3,909,006 issued Sep. 30, 1975 to R. Arbaugh on a Golf Putting Game; U.S. Pat. No. 3,990,708 issued Nov. 9, 1976 to S. Ingwersen on an Indoor/Outdoor Recreational Golf Facility; U.S. Pat. No. 4,222,568 issued Sep. 16, 1980 to O. Russo on a Golf Game Device Including Distortable Playing Surface; U.S. Pat. No. 4,240,637 issued Dec. 23, 1980 to R. Cross et al on a Putting Practice Apparatus; U.S. Pat. No. 4,247,112 issued Jan. 27, 1981 to A. DelRaso on a Golfing Putting Game Apparatus; U.S. Pat. No. 4,743,027 issued May 10, 1988 to L. Simjian on a Golf Practice Putting Device; U.S. Pat. No. 4,783,075 issued Nov. 8, 1988 to L. Simjian on a Golf Practice Putting Device; U.S. Pat. No. 4,790,538 issued Dec. 13, 1988 to I. Gettelfinger on a Golf Putting Practice Apparatus; U.S. Pat. No. 5,002,280 issued Mar. 26, 1991 to B. Hines on an Adjustable And Folding Putting Green and U.S. Pat. No. 5,005,837 issued Apr. 9, 1991 to P. Martinez on a Golf Trainer.

SUMMARY OF THE INVENTION

The present invention provides an apparatus for providing an adjustably contoured putting surface including a main platform defining an upper surface thereon for putting. The main platform is positioned spatially disposed above the adjacent environmental floor area. The platform preferably defines a first and second securement position spaced longitudinally therealong and located remotely with respect to one another preferably. The platform is preferably flexibly resilient between these two securement positions to facilitate variations in the contour of the putting surface.

The construction of the platform preferably includes two longitudinally extending side members to provide the longitudinal support therealong and a plurality of lateral support struts extending laterally between the longitudinally extending side members to provide lateral support.

An intermediate suspended support member is preferably fixedly secured with respect to the main platform between the first securement position and the second securement position to facilitate supporting thereof. The intermediate suspended support member preferably extends downwardly to a distance spaced above the floor area thereadjacent. The construction of the intermediate suspended support member preferably includes a first suspension leg member secured to the platform and extending downwardly therefrom as well as a second suspension leg member extending downwardly slightly longitudinally spaced from the first suspension leg member.

A first longitudinally extending suspension member such as a rod means or the like is preferably secured with respect to the main platform at the first securement position and is attached with respect to the intermediate suspended support member to facilitate supporting suspension thereof. This configuration preferably includes in more detail when utilizing a rod member the extension of this rod member between a first bracket attached with respect to the main platform and a second bracket attached with respect to the first suspension leg. With this first rod member extending between the first and second brackets and with the rod member being adjustably positionable thereadjacent suspension of the intermediate member is facilitated and adjustable positioning of the initial orientation of the contour is achieved.

In a similar fashion a second longitudinally extending suspension member may be attached with respect to the main platform at the second securement position and also be attached with respect to the intermediate suspended support member to aid in supporting suspension thereof. This second longitudinally extending suspension member can include a third bracket attached with respect to the main platform at the second securement position as well as a fourth bracket attached with respect to the second suspension leg member of the intermediate suspended support member. Also a second rod member may be adjustably positionable with respect to the third bracket and the fourth bracket to aid in supporting suspension of both legs of the intermediate suspended support member.

Furthermore, a third longitudinally extending suspension member may be attached with respect to the second and fourth brackets to interconnect and further support the first and second suspension leg members.

Control and powering of movement of the contoured surface is achieved by the inclusion of a pivotable platform support assembly secured with respect to the main platform for adjusting the contour of the upper surface of the main platform responsive to pivoting of the pivotable platform support assembly. The pivotable platform support assembly preferably includes a platform bracket fixedly secured with respect to the main platform with the platform bracket defining a platform pivot means thereon about which the platform bracket is adapted to be pivotable. Furthermore, a pivot pin may be included with the platform pivot.

In matching configuration a platform support stand may be secured with respect to the adjacent environmental floor area to define a support stand pivot position thereon. The platform pivot device is pivotally secured with respect to the support stand pivot to facilitate pivotal movement of the platform bracket means with respect to the platform support stand and the main platform with respect to the environmental floor area. The support stand pivot includes preferably a support stand bearing defining a bearing aperture therein adapted to receive the pivot pin extending therein to facilitate pivotal movement of the main platform with respect to the platform support stand.

A tilt actuator may be also included which preferably is electrically powered and is operative to be attached with respect to the platform bracket at a position away from the platform pivot for urging of the platform bracket in pivotal movement with respect to the platform support stand and urging the main platform to pivotal movement with respect to the adjacent environmental floor area. This tilt actuator is preferably movably or pivotally secured with respect to the adjacent environmental floor area at a tilt actuator pivot point.

Furthermore the present invention may include one or more stationary legs fixedly secured with respect to the main platform and with respect to the adjacent environmental floor area to facilitate support of the entire construction including the main platform thereabove.

It is an object of the present invention to provide an apparatus for providing an adjustably contoured putting surface wherein maintenance costs are minimized.

It is an object of the present invention to provide an apparatus for providing an adjustably contoured putting surface wherein down time resulting from maintenance is minimized.

It is an object of the present invention to provide an apparatus for providing an adjustably contoured putting surface wherein initial capital costs for installation are minimized.

It is an object of the present invention to provide an apparatus for providing an adjustably contoured putting surface wherein convenience of usage is enhanced.

It is an object of the present invention to provide an apparatus for providing an adjustably contoured putting surface wherein the contour of a golf putting surface can be varied over a wide range of possible contours.

It is an object of the present invention to provide an apparatus for providing an adjustably contoured putting surface wherein ease of adjustment of the contour of the putting surface is significantly enhanced.

It is an object of the present invention to provide an apparatus for providing an adjustably contoured putting surface wherein a golfer using the system can walk over the entire putting area with his weight being fully supported thereby.

It is an object of the present invention to provide an apparatus for providing an adjustably contoured putting surface wherein access to practicing golf putting strokes upon the contoured surface is facilitated by adjacently positioned steps.

It is an object of the present invention to provide an apparatus for providing an adjustably contoured putting surface wherein the contoured surface is of a very strong supporting construction however also being flexibly resilient to aid in varying of the contour of the golf putting surface.

It is an object of the present invention to provide an apparatus for providing an adjustably contoured putting surface wherein attachment to the surrounding floor area can be facilitated regardless of the type of floor or contour of the floor.

It is an object of the present invention to provide an apparatus for providing an adjustably contoured putting surface wherein accurate control of the contour variations can be achieved by an electrically powered tilt actuator.

It is an object of the present invention to provide an apparatus for providing an adjustably contoured putting surface wherein an automated putting lane is provided to facilitate convenience of usage thereof.

It is an object of the present invention to provide an apparatus for providing an adjustably contoured putting surface wherein full adjustment capability is provided for varying the initial steady state contour position prior to movement of the pivotable platform support assembly.

It is an object of the present invention to provide an apparatus for providing an adjustably contoured putting surface wherein a pivotable platform support assembly can be positioned at each opposite end of the platform to control the contour across the entire upper surface thereof.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
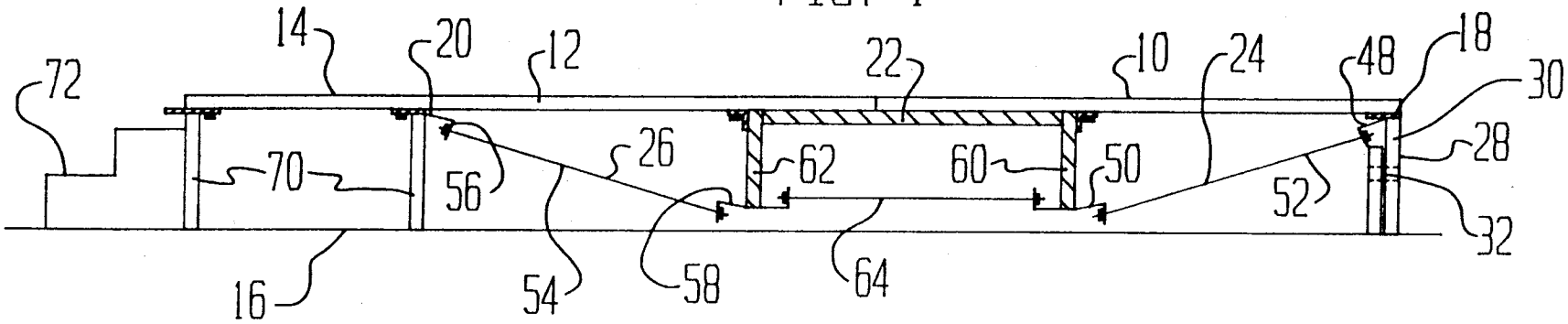
FIG. 1 is a side cross-sectional view of an embodiment of the apparatus for providing an adjustably contoured putting surface of the present invention.

The present invention provides an apparatus for providing an adjustably contoured putting surface 10 which comprises the upper surface 14 of the main platform means 12. This main platform 12 is designed to be positioned above a surrounding environmental floor area 16. The main platform 12 defines a first securement position 18 thereon and a second securement position 20 thereon. Positions 18 and 20 are longitudinally spaced with respect to one another.

Preferably the main platform 12 is somewhat flexibly resilient between the first securement position 18 and the second securement position 20 to allow variations in the contour of the upper surface 14 thereof to facilitate golf putting practice.

Control of positioning of the main platform 12 between the first securement position 18 and the second securement position 20 is facilitated by one or more intermediate suspended support members 22 positioned therebetween. Preferably the intermediate suspended support member includes a first suspension leg member 60 and a second suspension leg member 62 to aid in support of the main platform 14 between positions 18 and 20 and yet still allow flexibly resilient movement thereof.

Suspension of the first suspension leg member 60 and the second suspension leg member 62 is achieved by a first longitudinally extending suspension member 24 which may take the form of a first rod member 52. Rod member 52 is adapted to be attached at one end with respect to the main platform 12 at the first securement position 18 and is adapted to be attached with respect to the first suspension leg member 60 in an adjustable manner at the opposite end thereof. This is the preferred configuration for the first rod member 52 or more generally the first longitudinally extending suspension member 24.

In a similar manner the second longitudinally extending suspension member 26 which may comprise a second rod member 54 is preferably secured with respect to the second suspension leg member 62 at one end thereof and is preferably secured with respect to the second securement position 20 of the main platform 12 at the other end thereof.

To facilitate interconnection between the longitudinally extending suspension members 24 and 26 with respect to the main platform and the first and second suspension leg members 60 and 62, it is preferable to include a plurality of brackets.

A first bracket means 48 is preferably secured with respect to the main platform 12 adjacent the first securement position 18 defined thereof. First bracket means 48 is adapted to be adjustably secured with respect to the first rod member 52 to aid in suspension of the intermediate suspended support member 22 and in particular the first and second suspension leg members 60 and 62 thereof. A second bracket means 50 is adapted to be secured with respect to the first suspension leg member 60 to provide a means for attachment of the first rod member 52 with respect to the first suspension leg member 60 in an adjustable fashion. In a similar manner this attachment facilitates suspension of the first suspension leg member 62 and elevated support of the main platform 12 between the first securement position 18 and the second securement position 20.

A third bracket means 56 may be fixedly secured with respect to the main platform 12 adjacent the second securement position 20 defined thereon. Third bracket means 56 is designed to be adjustably attached preferably with respect to one end of the second longitudinally extending suspension member 26 or second rod member 54 in such a manner as to aid in suspension of the second suspension leg member 62 therefrom. In a similar manner a fourth bracket 58 is adapted to be secured with respect to the second suspension leg member 62 and is adjustably attached with respect to the second rod member 54 in such a manner as to facilitate firm suspended elevated support of the second suspension leg member 62 above the floor area 16 to aid suspended support thereof.

With this configuration the upper putting surface 14 will provide significant strength of support to allow a golfer to walk across the upper surface and fully support the weight of the player, while at the same time allowing variations in the contour of this same identical upper surface 14.

Control of movement of the main platform 12 can be facilitated by a pivotable platform support assembly 28. At least one such pivotable platform support assembly 28 will be included with the present invention attached to one end of the main platform means 12 for pivoting and controlling variations of the contour of the upper surface 14 of the main platform 12. The pivotable platform support assembly 28 preferably includes a platform bracket means 30 fixedly secured with respect to the main platform and defining a platform pivot means 32 about which the platform bracket means is adapted to pivot or partially rotate in such a manner as to vary the horizontal attitude of the main platform 12. A platform support stand 34 may be included fixedly secured with respect to a horizontal base member 16 or to the surrounding environmental floor area such as to define a support stand pivot means 36 defined thereon. The support stand pivot means 36 of platform support stand 34 will be interconnected with respect to the platform pivot means 32 of platform bracket 30 in such a manner as to allow pivotal movement of the platform bracket 30 with respect to the support stand pivot 36 thereby allowing pivotal movement of the main platform 12 with respect to the base member 16. To facilitate the control of this pivotal movement a support stand bearing means 42 may be positioned within the support stand pivot means 36. Support stand bearing means 42 will preferably define a bearing aperture 44 therein. Furthermore the platform pivot means 32 may include a pivot pin 46 adapted to extend through the bearing aperture 44 to thereby provide an axis of pivot between the aligned platform pivot means 32 and support stand pivot means 36 to facilitate pivotal movement between the main platform 12 and the base member 16 or floor area.

Control of this pivotal movement may be aided by the inclusion of a tilt actuator means 38 which is preferably electrically powered to urge movement of the platform bracket means 30 pivotally with respect to the platform support stand 34 as desired. Preferably the tilt actuator means 38 may be pivotally secured with respect to the platform bracket means 30 at tilt connection 74 thereof. To further in control of movement of the tilt actuator means 38, it may be connected with respect to the base member 16 a tilt actuator pivot 40 to thereby allow some tilting movement of the actuator means 38 itself relative to the base member 16 to give an added freedom of movement and flexibility to the design of the movable aspects of the pivotable platform support assembly 28.

To aid in support and strengthening of the first suspension leg member 60 and a second suspension leg member 62 of the intermediate suspended support member 22, it will be preferable to include a third longitudinally extending suspension member 64 which may be of a rod-like shape to extend between the first suspension leg member 60 and the second suspension leg member 62. Preferably third longitudinally extending suspension member 64 is attached with respect to the second bracket means 50 and fourth bracket means 58 to achieve this interconnection.

Figure 4:
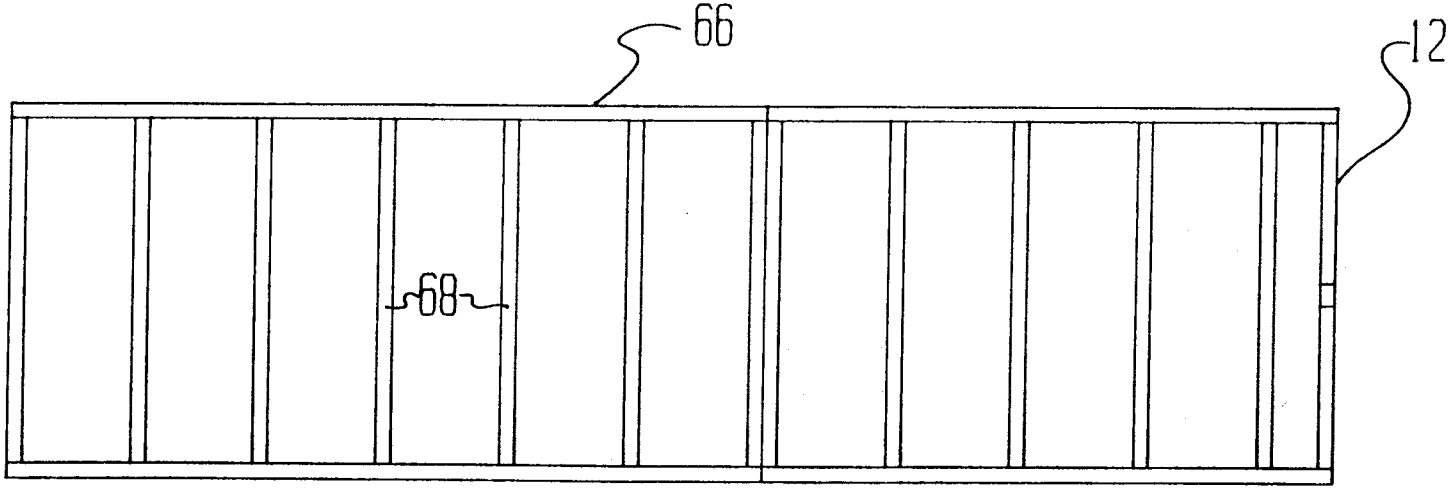
FIG. 4 is a top plan view of an embodiment of the construction of the main platform of the present invention.
Figures 2, 3:
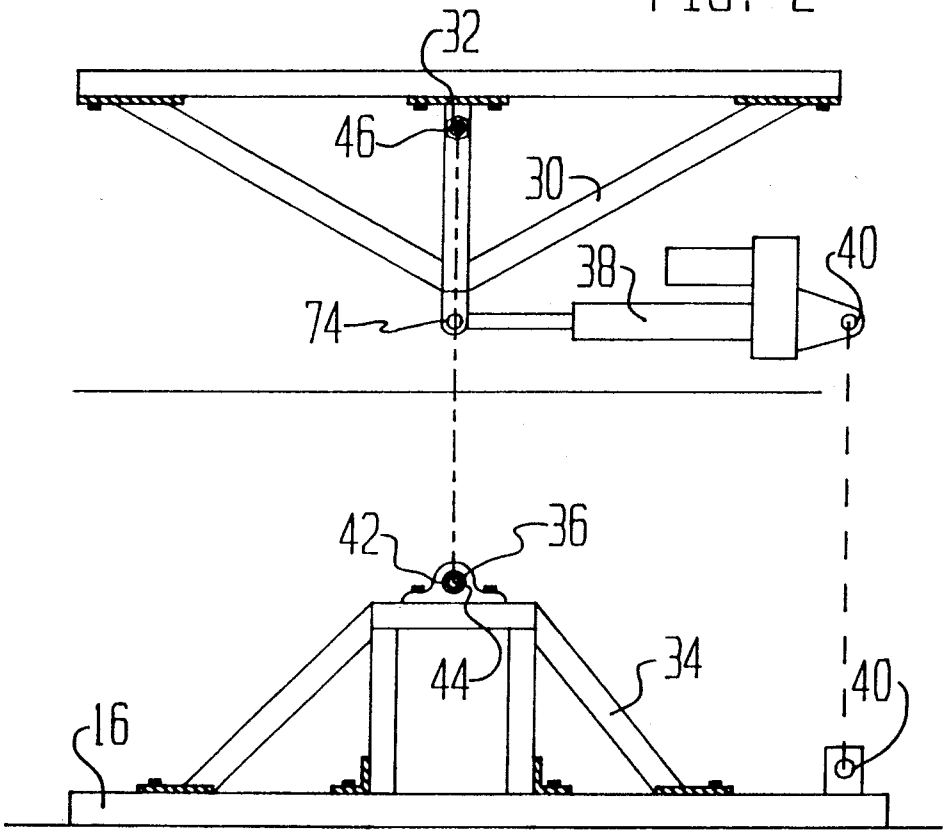
FIG. 2 is an end plan view of an embodiment of the pivotable platform support assembly of the present invention.
FIG. 3 is an end plan view of an embodiment of the platform support stand of the present invention.

It is important that the construction of the main platform 12 be of a strong yet flexibly resilient design. To achieve this design FIG. 4 shows a preferred design including two longitudinally extending side members 66 and a plurality of lateral support struts 68 extending therebetween. In this manner flexible resilience of the main platform 12 between the first securement position 18 and the second securement position 20 will be achieved while still allowing the full support characteristics desired for supporting the weight of the practicing golfer.

Fixed support of one or more sections of the main platform 12 can be achieved by the inclusion of a stationary leg means 70 where desired. Stationary leg means 70 are designed to preferably be fixedly secured with respect to the floor as well as fixedly secured with respect to the main platform 12 to thereby achieve a fixed and firm securement therebetween. Further aid in usage of the apparatus of the present invention is achieved by the inclusion of steps 72 adjacent one end or one side of the main platform 12 to facilitate access to the upper surface 14 of the apparatus by a practicing golfer.

In operation the main platform 12 of the present invention may define an upper surface 14 pre-set at any desired orientation. The pre-set orientation can be completely horizontally extending or it can be pre-set to a specific variable contour as desired. Control of this pre-set or steady-state orientation can be achieved by variation in the adjustments between the first and second rod members 52 and 54 with respect to the first, second, third and fourth brackets 48, 50, 56 and 58, respectively.

After some length of practice after a golfer desires a change in the orientation of the contour, a means of operation of the tilt actuator 38 can be provided. The tilt actuator or other means for urging movement of the pivotable platform support assembly 28 will vary the contour to the desired position as chosen by the golfer. The golfer can vary the position until the contour is as he desires. Actual control of pivotal movement of the pivotable platform support assembly 28 can be achieved by manual or the tilt actuator 38 as described herein. This tilt actuator can be electrically or pneumatically or hydraulically powered. With sufficient leverage even a cranking configuration can be included for powering of rotation of the platform bracket 30 with respect to platform support stand 34.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An apparatus for providing an adjustably contoured putting surface which comprises:

A. a main platform means defining an upper surface thereon for putting, said main platform means being positioned spatially disposed above the adjacent environmental floor area, said main platform means defining a first securement position and a second securement position thereon spatially disposed with respect to one another;

B. at least one intermediate suspended support member fixedly secured with respect to said main platform means between said first securement position and said second securement position to facilitate supporting thereof, said intermediate suspended support member extending downwardly to a distance less than the distance from said main platform means to the adjacent environmental floor area to be spatially disposed therefrom, said intermediate suspended support member including:

(1) a first suspension leg member secured to said main platform means and extending downwardly therefrom;

(2) a second suspension leg member secured to said main platform means and extending downwardly therefrom;

C. a first longitudinally extending suspension member attached with respect to said main platform means at said first securement position and attached with respect to said intermediate suspended support member to facilitate supporting suspension thereof;

D. a second longitudinally extending suspension member attached with respect to said main platform means at said second securement position and attached with respect to said intermediate suspended support member to further facilitate supporting suspension thereof;

E. a third longitudinally extending suspension member attached with respect to said first suspension leg member and said second suspension leg member to facilitate supporting suspension thereof; and F. at least one pivotable platform support assembly being secured with respect to said main platform means for adjusting the contour of said upper surface of said main platform means responsive to pivoting of said pivotable platform support assembly.

2. An apparatus for providing an adjustably contoured putting surface as defined in claim 1 wherein said pivotable platform support assembly comprises:

A. a platform bracket means fixedly secured with respect to said main platform means, said platform bracket means defining a platform pivot means thereon about which said platform bracket means is pivotable; and B. a platform support stand secured with respect to the adjacent environmental floor area and defining a support stand pivot means thereon, said platform pivot means being pivotally secured with respect to said support stand pivot means to facilitate pivotal movement of said platform bracket means with respect to said platform support stand and said main platform means with respect to the environmental floor area.

3. An apparatus for providing an adjustably contoured putting surface as defined in claim 2 wherein said pivotable platform support assembly further includes a tilt actuator means operatively attached with respect to said platform bracket means at a position spatially disposed from said platform pivot means for urging said platform bracket means in pivotal movement with respect to said platform support stand and urging said main platform means in pivotal movement with respect to the adjacent environmental floor area.

4. An apparatus for providing an adjustably contoured putting surface as defined in claim 3 wherein said tilt actuator means is electrically powered.

5. An apparatus for providing an adjustably contoured putting surface as defined in claim 3 wherein said tilt actuator means is pivotally secured with respect to the adjacent environmental floor area.

6. An apparatus for providing an adjustably contoured putting surface as defined in claim 2 wherein said support stand pivot means of said platform support stand includes a support stand bearing means defining a bearing aperture therein and wherein said platform pivot means of said platform bracket means includes a pivot pin positioned extending through said bearing aperture to facilitate pivotal movement of said main platform means with respect to said platform support stand.

7. An apparatus for providing an adjustably contoured putting surface as defined in claim 1 wherein said first longitudinally extending suspension member comprises:

A. a first bracket means attached with respect to said main platform means at said first securement position;

B. a second bracket means attached with respect to said intermediate suspended support member; and C. a first rod member, attached with respect to said first bracket means and said second bracket means to facilitate supporting suspension therefrom of said intermediate suspended support member.

8. An apparatus for providing an adjustably contoured putting surface as defined in claim 7 wherein said first rod member is adjustably secured with respect to said first bracket means.

9. An apparatus for providing an adjustably contoured putting surface as defined in claim 7 wherein said first rod member is adjustably secured with respect to said second bracket means.

10. An apparatus for providing an adjustably contoured putting surface as defined in claim 7 wherein said second longitudinally extending suspension member comprises:

A. a third bracket means attached with respect to said main platform means at said second securement position;

B. a fourth bracket means attached with respect to said intermediate suspended support member; and C. a second rod member attached with respect to said third bracket means and said fourth bracket means to facilitate supporting suspension therefrom of said intermediate suspended support member.

11. An apparatus for providing an adjustably contoured putting surface as defined in claim 10 wherein said second rod member is adjustably secured with respect to said third bracket means.

12. An apparatus for providing an adjustably contoured putting surface as defined in claim 10 wherein said second rod member is adjustably secured with respect to said fourth bracket means.

13. An apparatus for providing an adjustably contoured putting surface as defined in claim 1 wherein said main platform means is flexibly resilient between said first securement position defined thereon and said second securement position defined thereon.

14. An apparatus for providing an adjustably contoured putting surface as defined in claim 7 wherein said main platform means comprises:

A. two longitudinally extending side members to provide longitudinal support along said main platform means; and B. a plurality of lateral support struts extending between said longitudinally extending side members to provide lateral support therealong.

15. An apparatus for providing an adjustably contoured putting surface as defined in claim 1 further comprising at least one stationary leg means fixedly secured with respect to said main platform means and the adjacent environmental floor area to facilitate support of said main platform means.

16. An apparatus for providing an adjustably contoured putting surface as defined in claim 15 wherein said stationary leg means is secured with respect to said main platform means at said second securement position thereon.

17. An apparatus for providing an adjustably contoured putting surface which comprises:

A. a main platform means defining an upper surface thereon for putting, said main platform means being positioned spatially disposed above the adjacent environmental floor area, said main platform means defining a first securement position and a second securement position thereon spatially disposed with respect to one another, said main platform means being flexibly resilient at least between said first securement position and said second securement position, said main platform means further including;

(1) two longitudinally extending side members to provide longitudinal support along said main platform means;

(2) a plurality of lateral support struts extending between said longitudinally extending side members to provide lateral support therealong;

B. at least one intermediate suspended support member fixedly secured with respect to said main platform means between said first securement position and said second securement position to facilitate supporting thereof, said intermediate suspended support member extending downwardly to a distance less than the distance from said main platform means to the adjacent environmental floor area to be spatially disposed therefrom, said intermediate suspended support member including:

(1) a first suspension leg member secured to said main platform means and extending downwardly therefrom; and (2) a second suspension leg member secured to said main platform means and extending downwardly therefrom;

C. a first longitudinally extending suspension member attached with respect to said main platform means at said first securement position and attached with respect to said intermediate suspended support member to facilitate supporting suspension thereof, said first longitudinally extending suspension member further comprising;

(1) a first bracket means attached with respect to said main platform means at said first securement position;

(2) a second bracket means attached with respect to said first suspension leg member of said intermediate suspended support member; and (3) a first rod member adjustably attached with respect to said first bracket means and said second bracket means to facilitate supporting suspension therefrom of said intermediate suspended support member;

D. a second longitudinally extending suspension member attached with respect to said main platform means at said second securement position and attached with respect to said intermediate suspended support member to further facilitate supporting suspension thereof, said second longitudinally extending suspension member further comprising;

(1) a third bracket means attached with respect to said main platform means at said second securement position;

(2) a fourth bracket means attached with respect to said second suspension leg member of said intermediate suspended support member; and (3) a second rod member adjustably attached with respect to said third bracket means and said fourth bracket means to facilitate supporting suspension therefrom of said intermediate suspended support member;

E. a third longitudinally extending suspension member attached with respect to said second bracket means and said fourth bracket means to facilitate supporting of said first suspension leg member and said second suspension leg member;

F. at least one pivotable platform support assembly being secured with respect to said main platform means for adjusting the contour of said upper surface of said main platform means responsive to pivoting of said pivotable platform support assembly, said pivotable platform support assembly comprising:

(1) a platform bracket means fixedly secured with respect to said main platform means, said platform bracket means defining a platform pivot means thereon about which said platform bracket means is pivotable, said platform pivot means including a pivot pin;

(2) a platform support stand secured with respect to the adjacent environmental floor area and defining a support stand pivot means thereon, said platform pivot means being pivotally secured with respect to said support stand pivot means to facilitate pivotal movement of said platform bracket means with respect to said platform support stand and said main platform means with respect to the environmental floor area, said support stand pivot means including a support stand bearing means defining a bearing aperture there adapted to receive said pivot pin extending therein to facilitate pivotal movement of said main platform means with respect to said platform support stand;

(3) a tilt actuator means being electrically powered and operatively attached with respect to said platform bracket means at a position spatially disposed from said platform pivot means for urging said platform bracket means in pivotal movement with respect to said platform support stand and urging said main platform means in pivotal movement with respect to the adjacent environmental floor area, said tilt actuator means being movably secured with respect to the adjacent environmental floor area; and G. at least one stationary leg means fixedly secured with respect to said main platform means and the adjacent environmental floor area to facilitate support of said main platform means thereabove.

* * * * *

UNITED STATES PATENT AND TRADEMARK OFFICE

CERTIFICATE OF CORRECTION

PATENT NO. : 5,172,914

DATED : December 22, 1992

INVENTOR(S) : James Primerano

It is certified that error appears in the above-identified patent and that said Letters Patent is hereby corrected as shown below:

Column 9, line 57, change "7" to -- 1 --.

Signed and Sealed this

Second Day of November, 1993

*Attest:*

*Attesting Officer*

BRUCE LEHMAN

*Commissioner of Patents and Trademarks*